US005633697A

United States Patent [19]

Kinoshita

[11] Patent Number: 5,633,697

[45] Date of Patent: May 27, 1997

[54] PHOTOGRAPHIC PROCESSING APPARATUS

[75] Inventor: Togo Kinoshita, Wakayama, Japan

[73] Assignee: Noritsu Koki Co., Ltd., Wakayama, Japan

[21] Appl. No.: 590,287

[22] Filed: Jan. 23, 1996

[30] Foreign Application Priority Data

Jan. 23, 1995 [JP] Japan ..... 7-008235

[51] Int. Cl.[6] ..... G03D 3/02

[52] U.S. Cl. ..... 396/626; 396/630

[58] Field of Search ..... 354/310–313, 354/316–325, 331, 336; 134/64 P, 64 R, 122 P, 122 R; 430/398–400

[56] References Cited

U.S. PATENT DOCUMENTS 4,104,668 8/1978 Laar ..... 354/324 X 4,421,399 12/1983 Stuebe ..... 354/324 X 5,270,762 12/1993 Rosenburgh et al. ..... 354/324

5,309,191 5/1994 Bartell et al. ..... 354/324 X 5,311,236 5/1994 Ueffinger et al. ..... 354/324

FOREIGN PATENT DOCUMENTS

WO92/22852 12/1992 WIPO .

*Primary Examiner*—D. Rutledge

*Attorney, Agent, or Firm*—Smith Patent Office

[57] ABSTRACT

A photographic processing apparatus including a processing tank unit formed with a small volume for holding a processing solution for processing a continuous web of photographic material is disclosed. The apparatus includes a first circulation system having a circulation pump for circulating the processing solution through the tank unit and a second circulation system for mixing a replenisher, supplied through a replenisher supply system, with the processing solution and circulating the mixture through the first circulation system and the tank unit.

18 Claims, 4 Drawing Sheets

PHOTOGRAPHIC PROCESSING APPARATUS

BACKGROUND OF THE INVENTION

1. Field of the Invention

The present invention relates to a photographic processing apparatus, and, more particularly, to a photographic material processing apparatus for processing a continuous web of photographic material. The apparatus has a simplified structure to enable efficient supply of a replenishing solution to a processing tank.

2. Description of Related Art

Typically, photographic material wet processing, including development, bleach, fixation and stabilization, is accompanied by replenishment of a fresh processing solution mixed with auxiliary developer agents. In order to produce pictures of uniform quality, photographic materials are immersed in plenty of processing solution. While using large quantities of processing solution is advantageous in producing uniform quality pictures, various constraints should be imposed to keep the desired chemical characteristics of the processing solution. For instance, if only a small quantity of photographic material is processed in a large amount of processing solution, the processing solution is apt: 1) to be oxidized with air, 2) to have the chemical characteristics of its components deteriorate due to absorption of carbonic acid gas and/or 3) to lower its pH value, each of which can result in poor quality pictures. In view of the demands of controlling the chemical characteristics of the processing solution, reducing resources and maintaining the environment, it is desired to use the smallest quantities of processing and replenishing solutions as possible.

To meet these demands, use of a processing apparatus having a processing tank and a processing rack has been effective. This type of processing tank and rack are configured so as to form a small volume therebetween for holding a processing solution.

For the purpose of providing a brief background of this type of photographic processing apparatus to enhance understanding of the operation of a photographic processing apparatus according to the present invention, reference is made to FIG. 4 showing a prior art photographic paper processing or developing apparatus. As FIG. 4 shows, the photographic paper processing apparatus 100 is equipped with a processing solution circulation system 200 for circulating the processing solution through a processing tank 101 while processing photographic paper. The processing solution circulation system 200 includes a pump 205 to force the processing solution out from and into the processing tank 101 through a circulation conduit 204 extending between an inlet nozzle 102 and an outlet nozzle 103 of the processing tank 101. As the apparatus develops a large amount of photographic paper, the processing solution is gradually consumed and the processing solution's chemical performance deteriorates. To correct this chemical change, supply of the fresh processing solution including auxiliary developer agents, which are collectively referred to as a replenisher solution, or simply replenisher, is supplementarily compelled.

Supply of fresh replenisher through the circulation conduit 204 maintains a fresh and uniform quality processing solution, however, there are various structural constraints which must be imposed on the circulation system 200 for proper operation. In the prior art photographic paper processing apparatus 100, the processing tank 101 must be connected with both ends of the inlet and circulation conduit 204 (having a small drift space or cross-sectional area), at both the spout nozzle 102 and the discharge or outlet nozzle 103. This structure causes, on one hand, a sharp decrease in resistance in the processing solution being discharged into the circulation conduit 204 through the discharge nozzle 103 and, on the other hand, a sharp increase in resistance in the processing solution entering the spout nozzle 102 from the circulation conduit 204. These changes in resistance result in pressure fluctuations of the developing solution in the circulation conduit 204 which directly effect the liquid level of the replenisher in the replenisher tank 300. Accordingly, in order to handle the pressure differences, the circulation system 200 is not in any way allowed to be left open to air to make up for lost replenisher.

In place of providing an access opening in the circulation conduit 204, a pump 206 is incorporated in the circulation system 200 so as to force replenisher supply to the circulation conduit 204 through a filtering case. For the purpose of supplying replenisher, there is a strong demand for high performance pumps, such as a plunger type and a diaphragm type, both of which have high pressure discharging performance. These types of pumps are always relatively expensive as compared to a bellows pumps. A bellows pump, which is simple in structure and relatively inexpensive, is unsuitable for the circulation system 200 since it can not supply replenisher at a high pressure level.

Further, in order to reduce the pressure difference of the developing solution with respect to the atmospheric pressure caused due to resistance at the spout nozzle 102 and discharge nozzle 103, an orifice can be incorporated in the circulation conduit 204. The orifice allows the circulation conduit 204 to be open to air on either the upstream side or the downstream side from the orifice. Thus, replenisher can be supplied to the circulation conduit 204 through the opening. This configuration, however, causes an indispensable problem in that a restricted flow rate at the nozzles significantly aggravates the efficiency of the development of the photographic material.

Another prior art photographic processing apparatus intended to use only small quantities of processing solution and replenisher is disclosed in U.S. Pat. No. 5,270,762. The approach in reducing the quantity of processing solution used in U.S. Pat. No. 5,270,762 is to dimension a processing tank and a processing rack so as to form a small volume for holding the processing solution and photographic material. This structure allows use of a reduced quantity of processing solution and results in suppressing evaporation and deterioration or oxidization of processing solution. The photographic processing apparatuses of this type have the further advantage of miniaturization and simplification of the processing assembly.

In many instances where a processing tank and a processing rack are configured and assembled so as to form a small volume therebetween for holding a processing solution, it is still necessary to make up for the loss of processing solution through a replenishing system. Because of a small volume of processing solution servicing in the processing tank, the processing solution is concentrated in the processing tank in close proximity to the inlet due to the supply of fresh replenisher and becomes less in concentration in the processing tank in close proximity to the outlet as the result of deterioration of the processing solution. Further, while the processing solution has strong activity around the inlet, it is less agitated, resulting in an overall inferior mixture of the servicing processing solution and fresh processing solution within the processing tank. In other words, this type of processing tank assembly has the disadvantage of nonhomogeneous distribution of the concentration of processing solution in the processing tank, which can produce developing stain, developing marks and nonuniform picture quality.

SUMMARY OF THE INVENTION

It is an object of the present invention to provide a photographic processing apparatus which, while using as small a quantity of processing solution as possible, enables high precision supply of fresh replenisher to the processing solution in a circulation system so as to maintain the desired quality of the processing solution.

It is another object of the present invention to provide a photographic processing apparatus which enables use of a low pressure, fixed displacement pumping means, such as a bellows pump, in a replenishing system.

These objects of the present invention are achieved by providing a photographic processing apparatus for processing a continuous web of photographic material, such as photographic paper, which has a processing tank unit formed with a small volume for holding a processing solution. The processing tank unit comprises a processing tank and a processing rack which are integrally assembled to form a small volume for holding a processing solution therebetween. Further, the processing rack is formed with small volumes of vertical paths at opposite sides thereof for holding the processing solution and the continuous web of photographic material moving therethrough. The bottom of each path is in communication with the volume of the processing tank. The small volumes of the processing tank and the paths of the processing rack are connected for circulation of the processing solution through the processing tank assembly by means of a circulation system.

The circulation system includes first and second circulation means for circulating the processing solution through the processing tank assembly. The first circulation means includes a first circulation conduit connected between the first outlet and the inlet, and a circulation pumping means connected to the first circulation conduit so as to force the processing solution to flow through the first circulation conduit. The second circulation means includes a second circulation conduit connected between the first circulation conduit upstream from the circulation pumping means and the second outlet and a replenisher vessel in the second circulation conduit for holding a mixture of processing solution and replenisher. The replenisher vessel is open to the atmosphere and is supplied with a fixed quantity of replenisher by means of a replenisher supply means as a fixed length of the continuous web of photographic material is processed.

The replenisher supply means comprises a replenisher tank for containing the replenisher, a replenisher conduit connected at one end to the replenisher tank and detachably coupled at another end to the replenisher vessel, and replenisher pumping means connected to the replenisher conduit for delivering a fixed quantity of replenisher to the replenisher vessel. The replenisher pumping means may preferably employ a fixed displacement pump, such as a bellows type of fixed displacement pump. This type of pump is significantly less expensive than a high outlet pressure plunger types of fixed displacement pumps or high outlet pressure diaphragm types of fixed displacement pumps.

The replenisher vessel is formed with a connecting conduit through which the replenisher vessel is open to the atmosphere and to which the replenisher conduit is detachably coupled. Specifically, the connecting conduit has an inner diameter which is larger than an outer diameter of said replenisher conduit so as to form a small volume of air space between the connecting conduit and the replenisher conduit when coupled. The outlet end of the replenisher conduit is separated from the level of the processing solution in the replenisher vessel when it is coupled to the connecting conduit. The separation prevents flow of processing solution from the replenisher vessel into the replenisher conduit since the replenisher conduit supplies a precisely controlled quantity of replenisher solution.

The second circulation means further includes a restrictor, such as an orifice or a valve, installed in the second circulation conduit downstream from the replenisher vessel for restricting the flow rate of the processing solution in the second circulation conduit.

According to the photographic processing apparatus of the present invention, the first circulation means causes a negative pressure in the circulation conduit upstream from the circulation pumping means by means of which it induces circulation of a mixture of the processing solution and fresh replenisher in the replenisher vessel through the processing tank assembly. The use of a replenisher vessel open to the atmosphere in the second circulation means enables the processing solutions in the processing tank assembly and the replenisher vessel to be at approximately the same pressure level. The use of a restrictor in the second circulation conduit allows a relatively lower pressure downstream to develop. This pressure difference enables the use of a relatively low outlet pressure type of fixed displacement pumping means, such as a bellows type of pump which has the necessary accuracy of operation and is inexpensive.

BRIEF DESCRIPTION OF THE DRAWINGS

The above and other objects and features of the present invention will be clearly understood from the following description with respect to the preferred embodiments thereof when considered in conjunction with the accompanying drawings, in which.

DETAILED DESCRIPTION OF THE PREFERRED EMBODIMENTS

Parts which are not of direct importance to the invention and parts which are purely of conventional construction will not be described in detail. For example, details of the processing unit and its associated elements which are necessary for the photographic processing apparatus will not been set out in detail since their construction and operation can easily be arrived at by a person skilled in the art.

Figure 1:
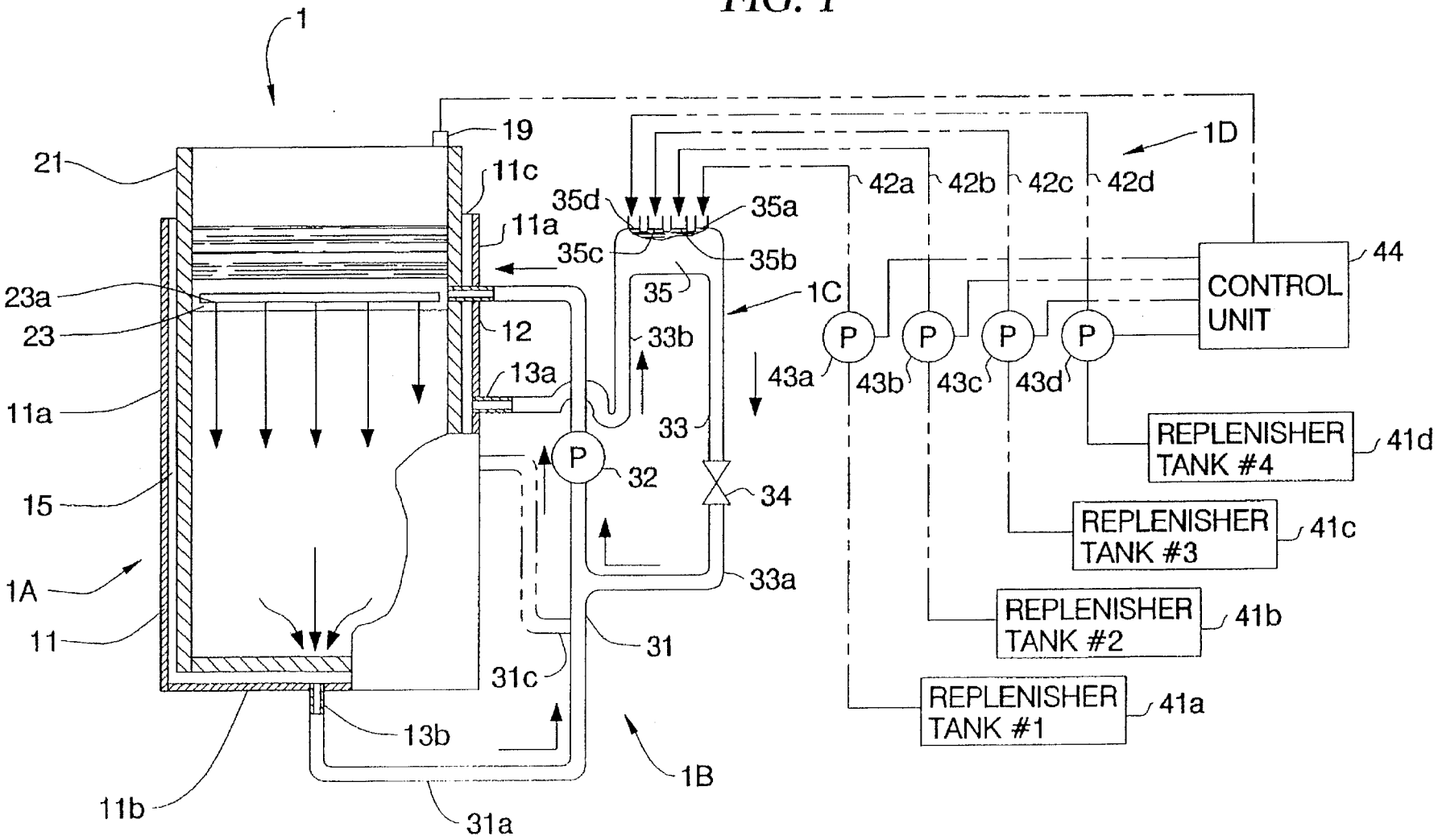
FIG. 1 is a schematic overall view, partly in cross-section, of a photographic processing apparatus according to a preferred embodiment of the present invention.

Referring to the drawings in detail, FIG. 1 shows a photographic processing or developing apparatus according to a preferred embodiment of the present invention. The photographic processing apparatus 1, such as a photographic paper processing or developing apparatus for processing a continuous web of exposed photographic paper, comprises a paper processing unit 1A, which is a main part of the processing apparatus 1, a first or primary processing solution circulation system 1B, a second or secondary processing solution circulation system 1C and a replenisher supply system 1D.

Figure 2:
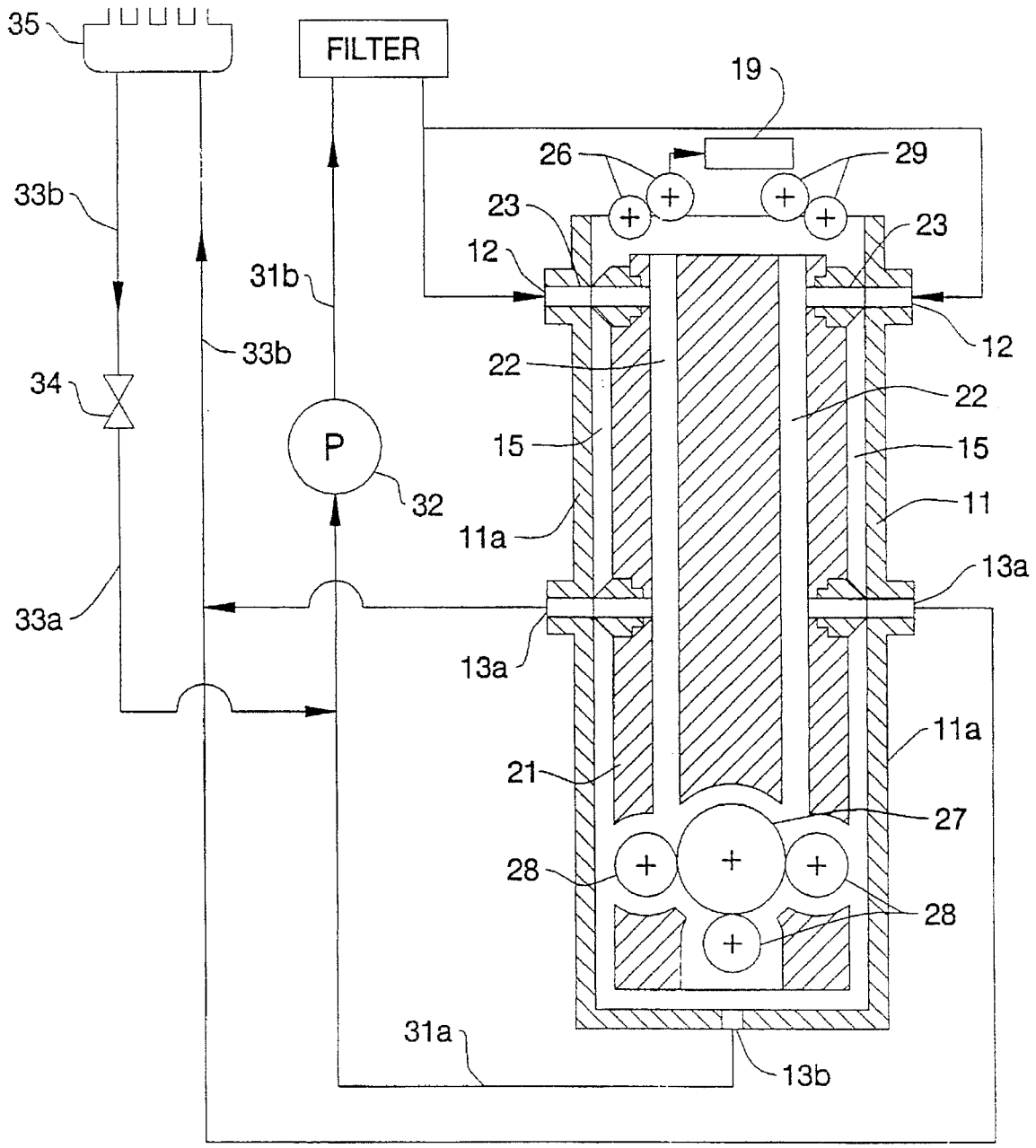
FIG. 2 is a vertical-sectional view of a processing tank unit of the photographic processing apparatus shown in FIG. 1.

As shown in detail in FIG. 2, the processing unit 1A includes a processing tank 11 and a processing rack 21, which are configured such that the processing rack 21 is removably inserted into the processing tank 11. The processing tank 11, which is open at the top and closed at the bottom, has an inlet 12 near the open top end 11*c* in each side wall 11*a* and a side outlet 13*a* below the inlet 12 in each side wall 11*a*. Further, the processing tank 11 has a bottom outlet 13*b* formed in a bottom wall 11*b*. The processing rack 21 has paper paths 22, extending from the top to the bottom of each side of the processing rack 21 and being in communication with a space at the bottom of the processing tank 11. A continuous web of exposed photographic paper is introduced into one of the paper paths 22 by means of feed rollers 26, passes between a transport roller 27 and idle rollers 28, is moved upward in another paper path 22 and is finally taken out of the processing tank 11 by means of take-out rollers 29.

Further, the processing rack 21 has a solution spout means 23 in each of outer walls 21*a* through which the processing solution is injected into the paper path 22. The processing solution, which is introduced into each paper path 22 through the solution spout means 23, flows down in the paper path 22 and is discharged out of the paper path 22 and the processing tank 11 through the bottom outlet 13*b*. The processing tank 11 and the processing rack 21 are designed and configured such that when the processing rack 12 is inserted in position, the solution spout means 23 are in alignment with the inlets 12, respectively, and a small volume space 15 is provided between the processing tank 11 and processing rack 21. While the solution spout means 23 may be an elongated slit type nozzle 23*a*, it is not limited to a slit type nozzle and may take any known type of aperture having an effective area smaller than the cross-sectional area of a circulation conduit 31 forming part of the primary processing solution circulation system 1B (which will be described in detail later).

In FIG. 1, the primary processing solution circulation system 1B includes a primary circulation conduit 31 comprising an upstream circulation conduit 31*a* coupled at its one end to the bottom outlet 13*b* of the processing tank 11 and at its other end to a circulation pump 32 and a downstream circulation conduit 31*b* coupled at its one end to the circulation pump 32 and at its other end to each inlet 12 of the processing tank 11.

The secondary processing solution circulation system 1C includes a secondary circulation conduit 33 comprising a downstream circulation conduit 33*a* branching off from the upstream circulation conduit 31*a*. The downstream circulation conduit 33*a* is provided with a restrictor or metering valve, such as an orifice 34. The downstream circulation conduit 33*a* is also coupled to a replenisher vessel 35 which is open to the atmosphere. The replenisher vessel can be a structure such as a manifold. The secondary processing circulation system 1C also includes an upstream circulation conduit 33*b* extending from the replenisher vessel 35 and is coupled to each of the side outlets 13*a*. The circulation pump 32, such as a positive displacement type of magnet pump, can deliver outlet pressures between $2.94\times10^4$ and $5.88\times10^4$ Pa (which is equivalent to between 0.3 and 0.6 kgf/cm$^2$).

Figure 3:
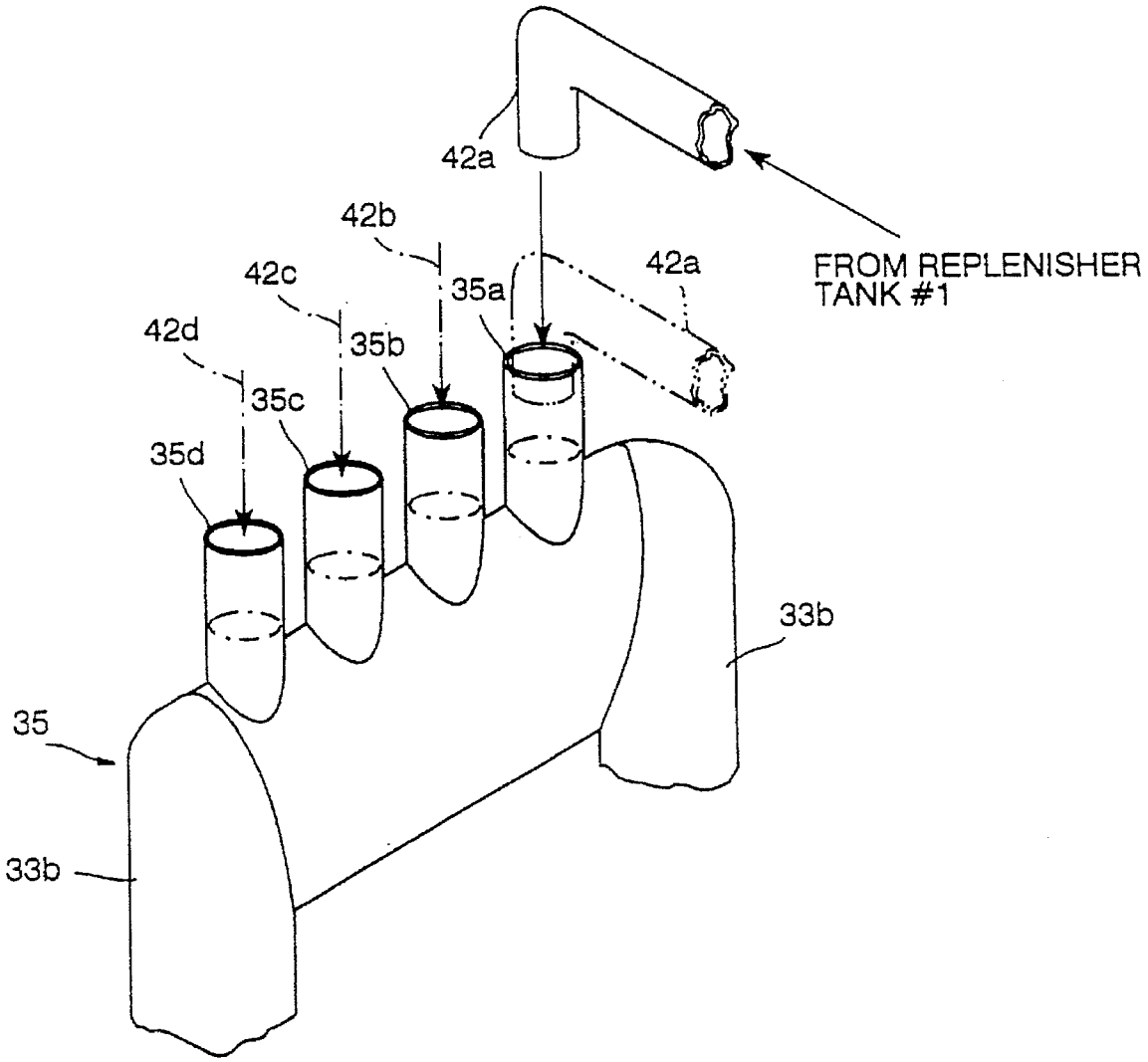
FIG. 3 is an enlarged perspective view of a replenisher vessel of the processing apparatus of FIG. 3.
Figure 4:
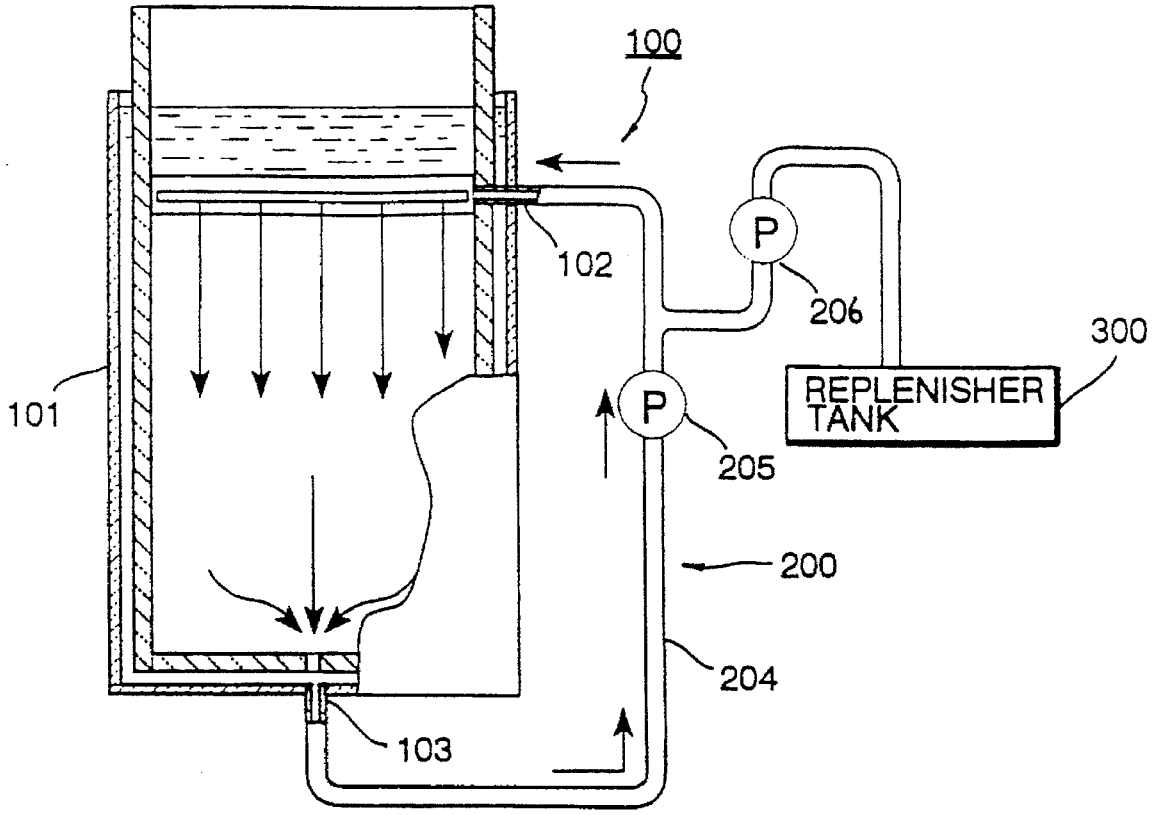
FIG. 4 (PRIOR ART)
FIG. 4 is a schematic overall view, partly in cross-section, of a prior art photographic processing apparatus.

Referring to FIGS. 1 and 3, the replenisher vessel 35 has a volume to contain replenisher of approximately 10 to 50 ml and is formed with at least one connecting conduit. Four connecting conduits 35*a*–35*d* are shown in this embodiment. While the replenisher vessel 35 is open to the atmosphere through these connecting conduits 35*a*–35*d*, various solutions, for instance a developing agent, a preservative, a contamination inhibitor and a hardening agent, are supplied independently through these connecting conduits 35*a*–35*d*, respectively, by means of the replenisher supply system 1D. Specifically, the replenisher supply system 1D includes first to fourth (#1 to #4) replenisher tanks 41*a*–41*d*. Each replenisher tank 41*a*–41*d* is coupled to one of the connecting conduits 35*a*–35*d* of the replenisher vessel 35 by means of a replenisher conduit 42*a*–42*d*. Each replenisher conduit 42*a*–42*d* is provided with a pump 43*a*–43*d*, preferably a fixed displacement pump, for delivering a fixed quantity of solution into the replenisher vessel 35. As clearly shown in FIG. 3, the replenisher conduit 42*a*–42*d* and the connecting conduit 35*a*–35*d* are designed and configured such that, they are easily detachably coupled to each other and, when they are coupled, a cylindrical air space is formed therebetween of sufficient size to enable the replenisher vessel 35 to be kept open to the atmosphere. In other words, the connecting conduits 35*a*–35*d* have inner diameters greater than the outer diameters of the replenisher conduits 42*a*–42*d*. It is to be noted that the outlet end of each replenisher conduit 42*a*–42*d* is separated from the level of the processing solution in the replenisher vessel 35 so that the processing solution in the replenisher vessel 35 does not flow into the replenisher conduits 42*a*–42*d*. The fixed displacement pumps 43*a*–43*d* are selectively activated when a predetermined area of exposed photographic paper is processed so as to supply a fixed quantity of an auxiliary agent, forming part of the replenisher, to the replenisher vessel 35. The processed area of photographic paper, which may be represented by a forwarded length of the photographic paper is measured by a measuring device 19 well known in the art. Quantities of these solutions to be periodically supplied are not always equal and are determined according to the specific processing conditions including the types and sizes of the photographic papers. The replenisher is mixed with the processing solution in the replenisher vessel 35. Because the replenisher vessel 35 is open to the atmosphere and the internal pressure of the replenisher vessel 35 is approximately equal to atmospheric pressure, the processing solution in the processing tank 11 and the replenisher in the replenisher vessel 35 are at the approximately the same level.

The processing solution mixed with replenisher is discharged into the upstream circulation conduit 31*a* of the primary circulation system 1B through the downstream circulation conduit 33*a* of the secondary circulation system 1C via the orifice 34. As is well known, the orifice 34 works as a restrictor to cause a pressure drop in a flow of discharged solution in the primary circulation conduit 31. Another type of restrictor, such as a metering valve, may be installed in place of the orifice 34. If such a metering valve is installed it can optimize the supply of the replenisher through regulated opening of the valve according to the processing circumstances including, for example, the outlet pressure of circulation pump 35, types of replenisher solutions and the atmospheric pressure.

Each of the fixed displacement pumps 43*a*–43*d* has a relatively low outlet pressure of, for instance, $4.9\times10^3$ to $9.8\times10^3$ Pa (which is equivalent to 0.05 to 0.1 kgf/cm$^2$). The fixed displacement pumps 43*a*–43*d* may be a bellows type or a diaphragm type as long as it satisfies the demands for required accuracy and is inexpensive.

In supplying the replenisher solution into the photographic processing apparatus shown in FIGS. 1 to 3 when the circulation pump 32 is actuated, the processing solution in the processing tank 11 is circulated as follows. The processing solution flows through the upstream circulation conduit 31*a* via the bottom outlet 13*b* of the processing tank 11 and the downstream circulation conduit 31*b*, and is then forced into the processing tank 11 through the solution spout means 23. While the processing solution is circulated by means of the primary circulation system 1B, a negative pressure is created in the primary circulation conduit 31 in the upstream proximity of the circulation pump 32, i.e. in the upstream circulation conduit 31*a*, which causes circulation of the processing solution through the secondary circulation system 1C. During this circulation, the processing solution is mixed with the replenisher in the replenisher vessel 35 and is forced to flow into the upstream circulation conduit 31*a* with the aid of the negative pressure and there it mixes with the partially degraded processing solution. While the processing solution is circulated by means of the primary and secondary circulating systems 1B and 1C, the exposed photographic paper is continuously moved through the paper paths 22. The paths 22 are filled with processing solution which is agitated due to the circulation.

Progress of processing the exposed photographic paper causes gradual consumption of the processing solution in the processing tank 11. When there is a demand for making up the loss, in other words, when the measuring device 19 detects the predetermined length of exposed photographic paper, it forwards this information to a control unit 44. The control unit 44 then automatically actuates the fixed displacement pumps 43*a*–43*d* to supply the required replenisher into the replenisher vessel 35 from the replenisher tanks 41*a*–41*d* through the replenisher conduits 42*a*–42*d*, respectively.

In order for the processing solution in the processing tank unit 1A to be more uniform in concentration distribution, an auxiliary circulation conduit 31*c* may be installed between the processing tank 11 and the first circulation conduit 31 upstream from the circulation pump 32. Further, the first and second circulation systems may be furnished independently for each of the different auxiliary developer agents, with a significant effect in many instances where counter flow tanks are installed.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A photographic processing apparatus for processing a continuous web of photographic material, said photographic processing apparatus comprising:

a processing tank unit having an inlet through which a processing solution is supplied and first and second outlets through which said processing solution is discharged, said processing tank unit holding the continuous web of photographic material;

first circulation means for circulating the processing solution through said processing tank unit, said first circulation means includes a first circulation conduit connected between said first outlet and said inlet and circulation pumping means connected to said first circulation conduit so as to force said processing solution to flow through said first circulation conduit;

second circulation means for circulating the processing solution through said processing tank unit, said second circulation means including a second circulation conduit connected between said first circulation conduit upstream from said circulation pumping means and said second outlet, said second circulation means further including replenisher vessel in said second circulation conduit for holding a mixture of the processing solution and a replenisher, said replenisher vessel being open to the atmosphere; and replenisher supply means for supplying a fixed quantity of replenisher to said replenisher vessel.

2. A photographic processing apparatus as defined in claim 1, further comprising means for monitoring a processed area of the continuous web of photographic material and means for actuating said replenisher supply means to supply the replenisher to said replenisher vessel when a specified total processed area of said continuous web of photographic material is detected.

3. A photographic processing apparatus as defined in claim 1, wherein said replenisher supply means comprises a replenisher tank for holding the replenisher, a replenisher conduit connected at one end to said replenisher tank and detachably coupled at another end to said replenisher vessel, and replenisher pumping means connected to said replenisher conduit for delivering a fixed quantity of replenisher to said replenisher vessel.

4. A photographic processing apparatus as defined in claim 3, wherein said replenisher pumping means comprises a fixed displacement pump.

5. A photographic processing apparatus as defined in claim 3, wherein said replenisher pumping means comprises a bellows type of fixed displacement pump.

6. A photographic processing apparatus as defined in claim 1, wherein said replenisher vessel is formed with a connecting conduit through which said replenisher vessel opens to the atmosphere and to which said replenisher conduit is detachably coupled.

7. A photographic processing apparatus as defined in claim 6, wherein said connecting conduit has an inner diameter which is larger than an outer diameter of said replenisher conduit so as to form an air space between said connecting conduit and said replenisher conduit when coupled.

8. A photographic processing apparatus as defined in claim 6, wherein an outlet end of said replenisher conduit is constructed and arranged to be separated from the level of said processing solution in said replenisher vessel when said replenisher conduit is coupled to said connecting conduit.

9. A photographic processing apparatus as defined in claim 1, wherein said second circulation means further includes a restrictor connected to said second circulation conduit downstream from said replenisher vessel for restricting a flow rate of said processing solution in said second circulation conduit.

10. A photographic processing apparatus as defined in claim 9, wherein said restrictor comprises an orifice.

11. A photographic processing apparatus as defined in claim 9, wherein said restrictor comprises a valve.

12. A photographic processing apparatus as defined in claim 1, wherein said processing tank unit comprises a processing tank and a processing rack, said processing rack being formed with vertical paths extending from the top to the bottom at opposite sides thereof, said vertical paths holding the continuous web of photographic material moving therethrough, the bottom of said vertical paths being in communication with said processing tank so as to allow said processing solution to circulate.

13. A photographic processing apparatus as defined in claim 12, further comprising solution spout means connected to said processing rack, said solution spout means being in communication with said first circulation conduit via said inlet and said vertical paths.

14. A photographic processing apparatus as defined in claim 13, wherein said solution spout means comprises a slit type of nozzle.

15. A photographic processing apparatus as defined in claim 13, wherein said processing rack and said processing tank are constructed and arranged so as to form a narrow space therebetween for holding the processing solution.

16. A photographic processing apparatus as defined in claim 15, wherein said second outlet is in communication with said processing tank.

17. A photographic processing apparatus as defined in claim 1, wherein said replenisher supply means independently supplies a plurality of auxiliary agents and fresh processing solution as replenisher.

18. A photographic processing apparatus as defined in claim 17, wherein the replenisher includes a developing agent, a preservative, a contamination inhibitor and a hardening agent.

* * * * *